US008171747B2

(12) United States Patent
Kurihara et al.

(10) Patent No.: US 8,171,747 B2
(45) Date of Patent: May 8, 2012

(54) REFRIGERATION DEVICE

(75) Inventors: Toshiyuki Kurihara, Sakai (JP); Shinichi Kasahara, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 478 days.

(21) Appl. No.: 12/439,977

(22) PCT Filed: Aug. 30, 2007

(86) PCT No.: PCT/JP2007/066861

§ 371 (c)(1), (2), (4) Date: Mar. 4, 2009

(87) PCT Pub. No.: WO2008/032581

PCT Pub. Date: Mar. 20, 2008

(65) Prior Publication Data

US 2010/0037647 A1 Feb. 18, 2010

(30) Foreign Application Priority Data

Sep. 11, 2006 (JP) ..... 2006-246154

(51) Int. Cl.
*F25B 41/04* (2006.01)

(52) U.S. Cl. ..... 62/222; 62/160; 62/208; 62/210; 62/212; 62/510

(58) Field of Classification Search ..... 62/160, 62/212, 222, 225, 509, 513
See application file for complete search history.

(56) References Cited

U.S. PATENT DOCUMENTS

| | | | | |
|---|---|---|---|---|
| 6,230,506 | B1 * | 5/2001 | Nishida et al. | 62/223 |
| 2003/0010046 | A1 * | 1/2003 | Freund et al. | 62/222 |
| 2006/0277932 | A1 * | 12/2006 | Otake et al. | 62/196.1 |

FOREIGN PATENT DOCUMENTS

| | | | |
|---|---|---|---|
| JP | 10-115470 | A | 5/1998 |
| JP | 2000-337722 | A | 12/2000 |
| JP | 2001-133058 | A | 5/2001 |
| JP | 2005-351537 | A | 12/2005 |
| JP | 2006-343017 | A | 12/2006 |

* cited by examiner

*Primary Examiner* — Frantz Jules
*Assistant Examiner* — Azim Rahim
(74) *Attorney, Agent, or Firm* — Global IP Counselors

(57) ABSTRACT

A refrigeration device includes a compression mechanism, a radiator, a first expansion mechanism (15), a liquid receiver (16), a second expansion mechanism, an evaporator, a temperature detector, a first pressure storing unit (23*a*), and a second pressure determining unit, a pressure detector, and a control unit (23*c*). The first pressure storing unit stores an upper limit and lower limit of an intermediate pressure. The second pressure determining unit determines an upper limit and lower limit of a high pressure based on the upper limit and lower limit of the intermediate pressure and on a temperature in a vicinity of an exit of the radiator. The control unit controls the first expansion mechanism and the second expansion mechanism so that a pressure detected by the pressure detector will be equal to or less than the upper limit and equal to or greater than the lower limit of the high pressure.

16 Claims, 5 Drawing Sheets

REFRIGERATION DEVICE

CROSS-REFERENCE TO RELATED APPLICATIONS

This U.S. National stage application claims priority under 35 U.S.C. §119(a) to Japanese Patent Application No. 2006-246154, filed in Japan on Sep. 11, 2006, the entire contents of which are hereby incorporated herein by reference.

TECHNICAL FIELD

The present invention relates to a refrigeration device, and particularly relates to a refrigeration device in which the refrigerant attains a supercritical state during the refrigeration cycle.

BACKGROUND ART

Conventional refrigeration devices are widely known that are provided with a refrigerant circuit in which a compressor, a radiator, a first expansion valve, a liquid receiver, a second expansion valve, and an evaporator are connected in sequence (see Japanese Laid-open Patent Application No. 10-115470, page 4, fifth column, line 12 through page 5, seventh column, line 39; FIG. 3).

SUMMARY OF THE INVENTION

Technical Problem

In cases where carbon dioxide or another supercritical refrigerant is employed as a refrigerant in a refrigerant circuit of such refrigeration devices, making the pressure ("intermediate pressure" hereunder) of the refrigerant that flows from the first expansion valve to the second expansion valve dramatically lower than the saturation pressure causes large quantities of refrigerant gas to be generated, and the refrigerant level in the liquid receiver harder to control.

It is an object of the present invention to enable stable control over the refrigerant level in the liquid receiver in a refrigeration device of the above description.

Solution to Problem

A refrigeration device according to a first aspect of the present invention comprises a compression mechanism, a radiator, a first expansion mechanism, a liquid receiver, a second expansion mechanism, an evaporator, a temperature detector, a first pressure storing unit, a second pressure determining unit, a pressure detector, and a control unit. The compression mechanism compresses a refrigerant. The radiator is connected to a refrigerant discharge side of the compression mechanism. The first expansion mechanism is connected to an exit side of the radiator. The liquid receiver is connected to a refrigerant outflow side of the first expansion mechanism. The second expansion mechanism is connected to an exit side of the liquid receiver. The evaporator is connected to a refrigerant outflow side of the second expansion mechanism and to a refrigerant intake side of the compression mechanism. The temperature detector is disposed between the exit side of the radiator and a refrigerant inflow side of the first expansion mechanism. The first pressure storing unit stores an upper limit and lower limit of the first pressure. The "first pressure" referred to herein is the pressure of the refrigerant that flows from the refrigerant outflow side of the first expansion mechanism to the refrigerant intake side of the second expansion mechanism. The second pressure determining unit determines the upper and lower limits of the second pressure from the upper and lower limits of the first pressure and the temperature detected by the temperature detector. The "second pressure" referred to herein is the pressure of the refrigerant that flows from the refrigerant discharge side of the compression mechanism to the refrigerant intake side of the first expansion mechanism. The pressure detector is provided between the refrigerant discharge side of the compression mechanism and the refrigerant inflow side of the first expansion mechanism. The control unit controls the first expansion mechanism and the second expansion mechanism in such a manner that the pressure detected by the pressure detector will be equal to or less than the upper limit and equal to or higher than the lower limit of the second pressure, and so that the first pressure will be equal to or less than the upper limit and equal to or higher than the lower limit of the first pressure.

According to this refrigeration device, the second pressure determining unit determines the upper and lower limits of the second pressure from the upper and lower limits of the first pressure and the temperature detected by the temperature detector. The control unit controls the first expansion mechanism and the second expansion mechanism in such a manner that the pressure detected by the pressure detector will be equal to or less than the upper limit and equal to or higher than the lower limit of the second pressure, and so that the first pressure will be equal to or less than the upper limit and equal to or higher than the lower limit of the first pressure. The first pressure and the second pressure can accordingly both be kept at optimal levels in the refrigeration device. Therefore, in the refrigeration device, the refrigerant level in the liquid receiver can be stably controlled as long as the upper limit and lower limit of the first pressure are set so that the refrigerant flowing out from the first expansion mechanism will attain a state close to the saturation line, but not a state close to the supercritical point. In a case where a supercooling heat exchanger (which may be an internal heat exchanger) is provided between the liquid receiver and the second expansion mechanism, it will be necessary to set the upper and lower limit of the first pressure while also ensuring there is a difference in temperature between the high and low pressures of the supercooling heat exchanger. If such an arrangement is followed, it will be possible to avoid increasing the scale of the supercooling heat exchanger.

A refrigeration device according to a second aspect of the present invention is the refrigeration device according to the first aspect of the present invention, further comprising a heat exchanger for cooling a refrigerant. The heat exchanger for cooling a refrigerant is disposed between the exit side of the radiator and a refrigerant inflow side of the first expansion mechanism. The temperature detector is disposed between the exit side of the heat exchanger for cooling a refrigerant and a refrigerant inflow side of the first expansion mechanism.

In the refrigeration device, the temperature detector is provided between the exit side of the heat exchanger for cooling a refrigerant and a refrigerant inflow side of the first expansion mechanism. It is thus possible for the control according to the present invention to be performed by the refrigeration device even in a case where a heat exchanger for cooling a refrigerant is provided.

Advantageous Effects of Invention

According to the refrigeration device of the first aspect of the invention, it is possible to keep the first pressure and second pressure at optimal levels. The refrigeration device thus enables the refrigerant level in the liquid receiver to be stably controlled as long as the upper limit and lower limit of the first pressure are set so that the refrigerant flowing out from the first expansion mechanism will attain a state close to the saturation line, but not a state close to the supercritical point. In a case where a supercooling heat exchanger (which may be an internal heat exchanger) is provided between the liquid receiver and the second expansion mechanism, it will be necessary to set the upper and lower limit of the first pressure while also ensuring there is a difference in temperature between the high and low pressures of the supercooling heat exchanger. If such an arrangement is followed, it will be possible to avoid increasing the scale of the supercooling heat exchanger.

According to the refrigeration device of the second aspect of the invention, it is possible to perform the control according to the present invention even in cases where a supercooling heat exchanger is provided.

DETAILED DESCRIPTION OF THE INVENTION

<Structure of Air Conditioning Device>

Figure 1:
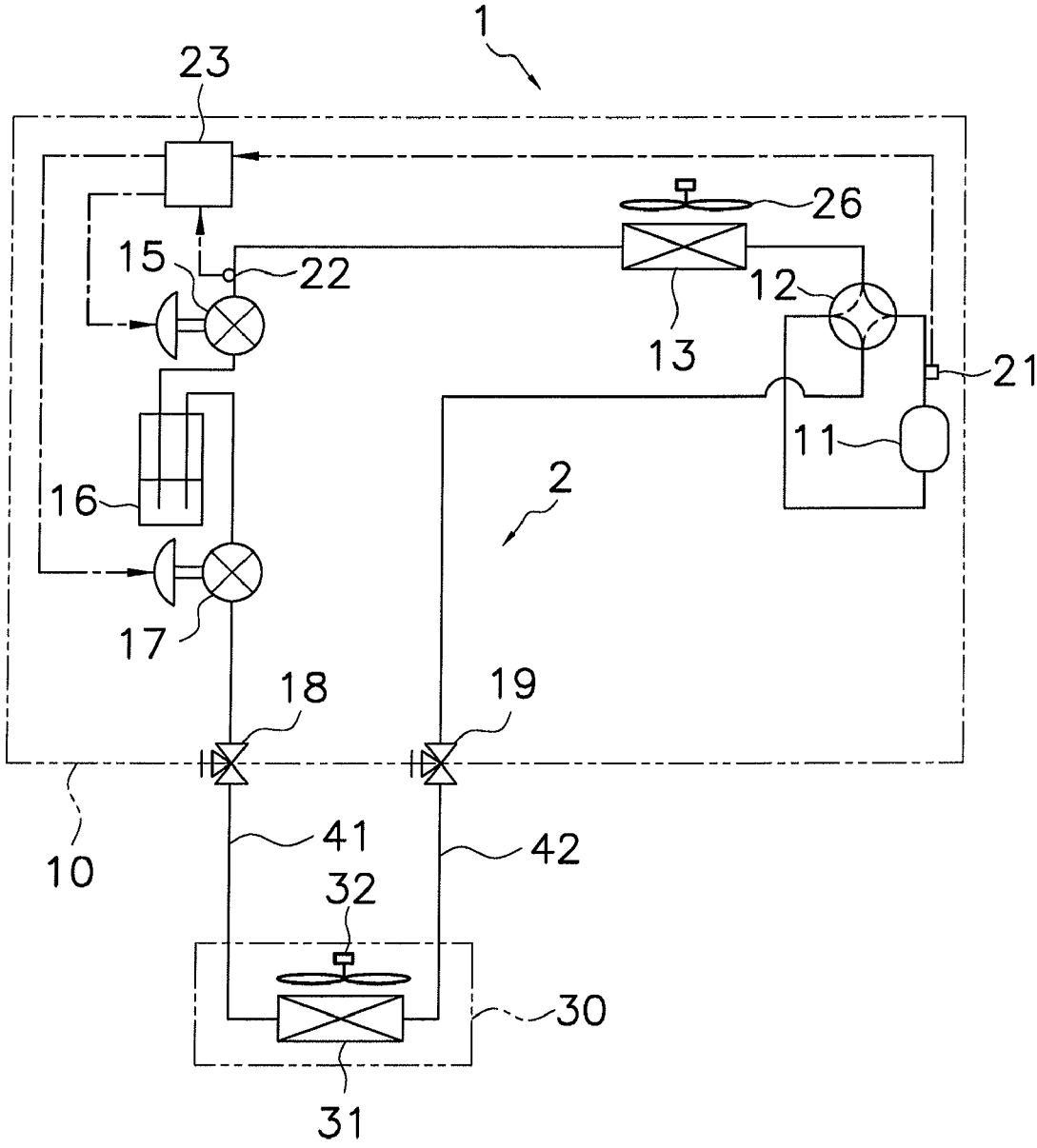
FIG. 1 is a diagram showing the refrigerant circuit of an air conditioning device according to an embodiment of the present invention.

FIG. 1 is a schematic view of a refrigerant circuit 2 of an air conditioning device 1 according to an embodiment of the present invention.

This air conditioning device 1 is an air conditioning device that is capable of cooling operation and heating operation using carbon dioxide as the refrigerant, and is primarily composed of a refrigerant circuit 2, blower fans 26, 32, a control device 23, a high-pressure sensor 21, a temperature sensor 22, and other components.

The refrigerant circuit 2 is equipped primarily with a compressor 11, a four-way switch valve 12, an outdoor heat exchanger 13, a first electric expansion valve 15, a liquid receiver 16, a second electric expansion valve 17, and an indoor heat exchanger 31, and the devices are connected via a refrigerant pipe, as shown in FIG. 1.

In the present embodiment, the air conditioning device 1 is a separate-type air conditioning device, and can also be described as comprising an indoor unit 30 primarily having the indoor heat exchanger 31 and an indoor fan 32; an outdoor unit 10 primarily having the compressor 11, the four-way switch valve 12, the outdoor heat exchanger 13, the first electric expansion valve 15, the liquid receiver 16, the second electric expansion valve 17, the high-pressure sensor 21, the temperature sensor 22, and the control device 23; a first connecting pipe 41 for connecting the pipe for refrigerant fluid and the like of the indoor unit 30 and the pipe for refrigerant fluid and the like of the outdoor unit 10; and a second connecting pipe 42 for connecting the pipe for refrigerant gas and the like of the indoor unit 30 and the pipe for refrigerant gas and the like of the outdoor unit 10. The first connecting pipe 41 and the pipe for refrigerant fluid and the like of the outdoor unit 10 are connected via a first close valve 18 of the outdoor unit 10, and the second connecting pipe 42 and the pipe for refrigerant gas and the like of the outdoor unit 10 are connected via a second close valve 19 of the outdoor unit 10.

(1) Indoor Unit

The indoor unit 30 primarily has the indoor heat exchanger 31, the indoor fan 32, and other components.

The indoor heat exchanger 31 is a heat exchanger for exchanging heat between the refrigerant and the indoor air, which is the air inside the room to be air-conditioned.

The indoor fan 32 is a fan for taking the air inside the air-conditioned room into the unit 30 and blowing conditioned air, which is the air after heat exchange with the refrigerant via the indoor heat exchanger 31, back into the air-conditioned room.

Employing such a configuration makes it possible for the indoor unit 30 to cause heat to be exchanged between the indoor air taken in by the indoor fan 32 and the liquid refrigerant that flows through the indoor heat exchanger 31, and generate conditioned air (cool air) during cooling operation, as well as to cause heat to be exchanged between the indoor air taken in by the indoor fan 32 and supercritical refrigerant that flows through the indoor heat exchanger 31, and generate conditioned air (warm air) during heating operation.

(2) Outdoor Unit

The outdoor unit 10 primarily has the compressor 11, the four-way switch valve 12, the outdoor heat exchanger 13, the first electric expansion valve 15, the liquid receiver 16, the second electric expansion valve 17, an outdoor fan 26, the control device 23, the high-pressure sensor 21, the temperature sensor 22, and other components.

The compressor 11 is a device for sucking in low-pressure refrigerant gas flowing through an intake pipe and compressing the refrigerant gas to a supercritical state, and then discharging the refrigerant to a discharge pipe.

The four-way switch valve 12 is a valve for switching the flow direction of the refrigerant in accordance with each operation mode, and is capable of connecting the discharge side of the compressor 11 and the high-temperature side of the outdoor heat exchanger 13, and connecting the intake side of the compressor 11 and the gas side of the indoor heat exchanger 31 during cooling operation; as well as connecting the discharge side of the compressor 11 and the second close valve 19, and connecting the intake side of the compressor 11 and the gas side of the outdoor heat exchanger 13 during heating operation.

The outdoor heat exchanger 13 is capable of cooling the high-pressure supercritical refrigerant discharged from the compressor 11 using the air outside the air-conditioned room as a heat source during cooling operation, and evaporating the liquid refrigerant returning from the indoor heat exchanger 31 during heating operation.

The first electric expansion valve 15 reduces the pressure of the supercritical refrigerant (during cooling operation) that flows out from the low-temperature side of the outdoor heat exchanger 13, or the liquid refrigerant (during heating operation) that flows in through the liquid receiver 16.

The liquid receiver 16 stores refrigerant that occurs as excess depending on the operating mode or the air conditioning load.

The second electric expansion valve 17 reduces the pressure of the liquid refrigerant (during cooling operation) that flows in through the liquid receiver 16, or the supercritical refrigerant (during heating operation) that flows out from the low-temperature side of the indoor heat exchanger 31.

The outdoor fan 26 is a fan for taking the outdoor air into the unit 10 and discharging the air after heat exchange with the refrigerant via the outdoor heat exchanger 13.

The high-pressure sensor 21 is provided to the discharge side of the compressor 11.

The temperature sensor 22 is provided in proximity to an entry of the first electric expansion valve 15.

Figure 2:
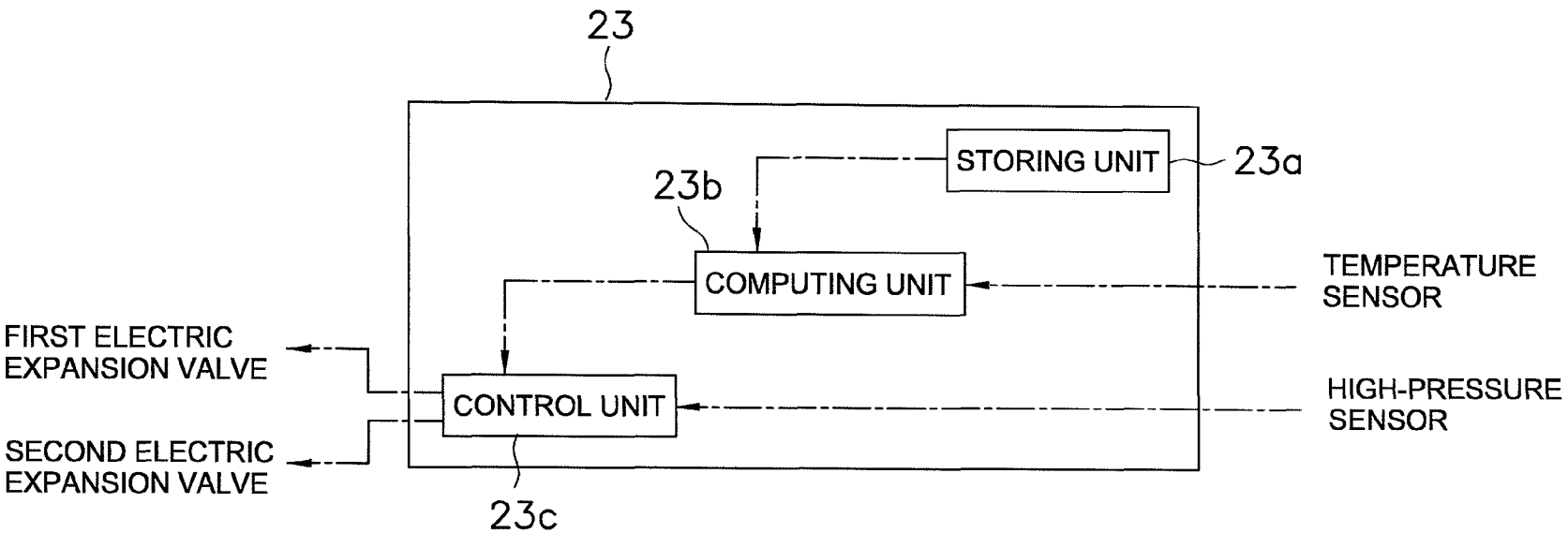
FIG. 2 is a block diagram showing functions of a control device provided to an air conditioning device according to an embodiment of the present invention.
Figure 3:
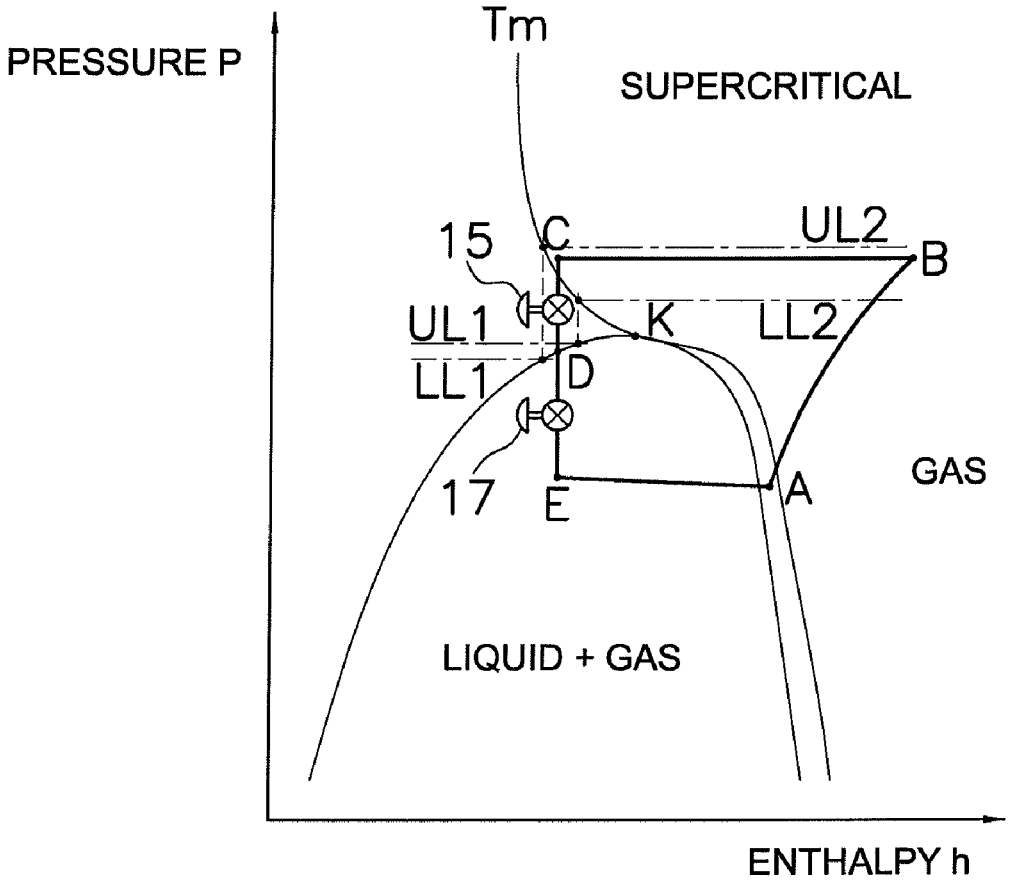
FIG. 3 is a diagram for describing the control of the level in the liquid receiver by the control device of the air conditioning device according to an embodiment of the present invention.

The control device 23 has a communication connection with the high-pressure sensor 21, the temperature sensor 22, the first electric expansion valve 15, the second electric expansion valve 17, and other components, and controls the degree of opening of the first electric expansion valve 15 and the second electric expansion valve 17 on the basis of temperature information transmitted from the temperature sensor 22, and high-pressure information transmitted from the high-pressure sensor 21. The control device 23 is primarily composed of a storing unit 23*a*, a computing unit 23*b*, and a control unit 23*c*, as shown in FIG. 2. The storing unit 23*a* stores information of upper limit UL1 and lower limit LL1 of the pressure of the refrigerant ("intermediate-pressure refrigerant" hereunder) that flows between the refrigerant outflow side of the first electrical expansion valve 15 and the refrigerant inflow side of the second electric expansion valve 17. The upper limit UL1 and lower limit LL1 are set so that the refrigerant flowing out from the first electric expansion valve 15 will attain a state close to the saturation line, but not a state close to the supercritical point (see FIG. 3). The computing unit 23*b* uses the information of the upper limit UL1 and lower limit LL1 of the pressure of the intermediate pressure refrigerant sent by the storing unit 23*a*, as well as temperature information transmitted by the temperature sensor 22, to compute an upper limit UL2 and a lower limit LL2 of the pressure of the refrigerant ("high-pressure-side refrigerant" hereunder) that flows between the refrigerant discharge side of the compressor 11 and the refrigerant inflow side of the first electric expansion valve 15, as shown in FIG. 3. The upper limit UL2 and lower limit LL2 of pressure of the high-pressure-side refrigerant are set by determining the points at which each of the upper limit UL1 and lower limit LL1 of the pressure of the intermediate-pressure refrigerant intersect the saturation line on the low enthalpy side relative to the supercritical point K, extending hypothetical lines along the vertical axis from the points of intersection, and determining the points at which these hypothetical lines intersect the isothermal line Tm corresponding to the temperature information at that time, as is also shown in FIG. 3. Such computations can be readily performed by one skilled in the art using techniques for expressing functions and techniques for creating control tables. The control unit 23*c* controls the degree of opening of the first electric expansion valve 15 and the second electric expansion valve 17 so that the value shown by the high-pressure sensor 21 will fall between the upper limit UL2 and lower limit LL2 of the pressure of the high-pressure-side refrigerant as determined above, and so that the pressure of the intermediate pressure refrigerant will fall between the upper limit UL1 and lower limit LL1 of the pressure of the intermediate-pressure refrigerant. The pressure of the high-pressure-side refrigerant at this time is exclusively controlled by the first electric expansion valve 15. The pressure of the intermediate-pressure refrigerant is controlled by the balance between the degree of opening of the first electric expansion valve 15 and the degree of opening of the second electric expansion valve 17. The degree of opening of the second electric expansion valve 17 at this time can be readily determined provided that the degree of opening of the second electric expansion valve 17 is expressed in advance as a function using, e.g., the pressure of the intermediate-pressure refrigerant and the degree of opening of the first electric expansion valve 15 as variables. The average of the upper limit UL1 and lower limit LL1 or another value may be used as the pressure value of the intermediate-pressure refrigerant used at this time.

<Operation of the Air Conditioning Device>

The operation of the air conditioning device 1 will be described using FIG. 1. This air conditioning device 1 is capable of cooling operation and heating operation, as described above.

(1) Cooling Operation

During cooling operation, the four-way switch valve 12 is in the state indicated by the solid line in FIG. 1, i.e., a state in which the discharge side of the compressor 11 is connected to the high-temperature side of the outdoor heat exchanger 13, and the intake side of the compressor 11 is connected to the second close valve 19. The first close valve 18 and the second close valve 19 are also open at this time.

When the compressor 11 is activated in this state of the refrigerant circuit 2, the refrigerant gas is sucked into the compressor 11 and compressed to a supercritical state, and then sent through the four-way switch valve 12 to the outdoor heat exchanger 13 and cooled in the outdoor heat exchanger 13.

This cooled supercritical refrigerant is sent to the first electric expansion valve 15. The supercritical refrigerant sent to the first electric expansion valve 15 is depressurized to a saturated state, and then sent to the second electric expansion valve 17 via the liquid receiver 16. The refrigerant in a saturated state sent to the second electric expansion valve 17 is depressurized to liquid refrigerant, and then fed to the indoor heat exchanger 31 via the first close valve 18, where the refrigerant cools the indoor air and evaporates into refrigerant gas.

The refrigerant gas is again sucked into the compressor 11 via the second close valve 19, and the four-way switch valve 12. Cooling operation is performed in this manner.

(2) Heating Operation

During heating operation, the four-way switch valve 12 is in the state indicated by the dashed line in FIG. 1, i.e., a state in which the discharge side of the compressor 11 is connected to the second close valve 19, and the intake side of the compressor 11 is connected to the gas side of the outdoor heat exchanger 13. The first close valve 18 and the second close valve 19 are also open at this time.

When the compressor 11 is activated in this state of the refrigerant circuit 2, the refrigerant gas is sucked into the compressor 11 and compressed to a supercritical state, and then is fed to the indoor heat exchanger 31 via the four-way switch valve 12 and the second close valve 19.

The supercritical refrigerant heats the indoor air, and is cooled in the indoor heat exchanger 31. The cooled supercritical refrigerant is sent through the first close valve to the second electric expansion valve 17. The supercritical refrigerant sent to the second electric expansion valve 17 is depressurized to a saturated state, and then sent to the first electric expansion valve 15 via the liquid receiver 16. The refrigerant in a saturated state sent to the first electric expansion valve 15 is depressurized to liquid refrigerant, and then sent to the outdoor heat exchanger 13 and evaporated to refrigerant gas in the outdoor heat exchanger 13. This refrigerant gas is again sucked into the compressor 11 via the four-way switch valve 12. Heating operation is performed in this manner.

<Characteristics of the Air Conditioning Device>

According to the air conditioning device 1 of the present embodiment, the information of upper limit UL1 and lower limit LL1 to the effect that the intermediate-pressure refrigerant will attain a state close to the saturation line, but not a state close to the supercritical point, are stored in the storing unit 23*a*; and the computing unit 23*b* uses the information of the upper limit UL1 and the lower limit LL1, as well as temperature information transmitted by the temperature sensor 22, to compute upper limit UL2 and lower limit LL2 of the pressure of the high-pressure-side refrigerant. The control unit 23*c* controls the degree of opening of the first electric expansion valve 15 and the second electric expansion valve 17 so that the value shown by the high-pressure sensor 21 will fall between the upper limit UL2 and lower limit LL2 of the pressure of the high-pressure-side refrigerant as determined above, and so that the pressure of the intermediate-pressure refrigerant will fall between the upper limit UL1 and lower limit LL1 of the pressure of the intermediate-pressure refrigerant. In the air conditioning device 1, the pressure of the intermediate-pressure refrigerant and the pressure of the high-pressure-side refrigerant can accordingly be held at optimal levels. Therefore, in the air conditioning device 1, the refrigerant level in the liquid receiver 16 can be stably controlled.

<Modifications>

(A)

Figure 4:
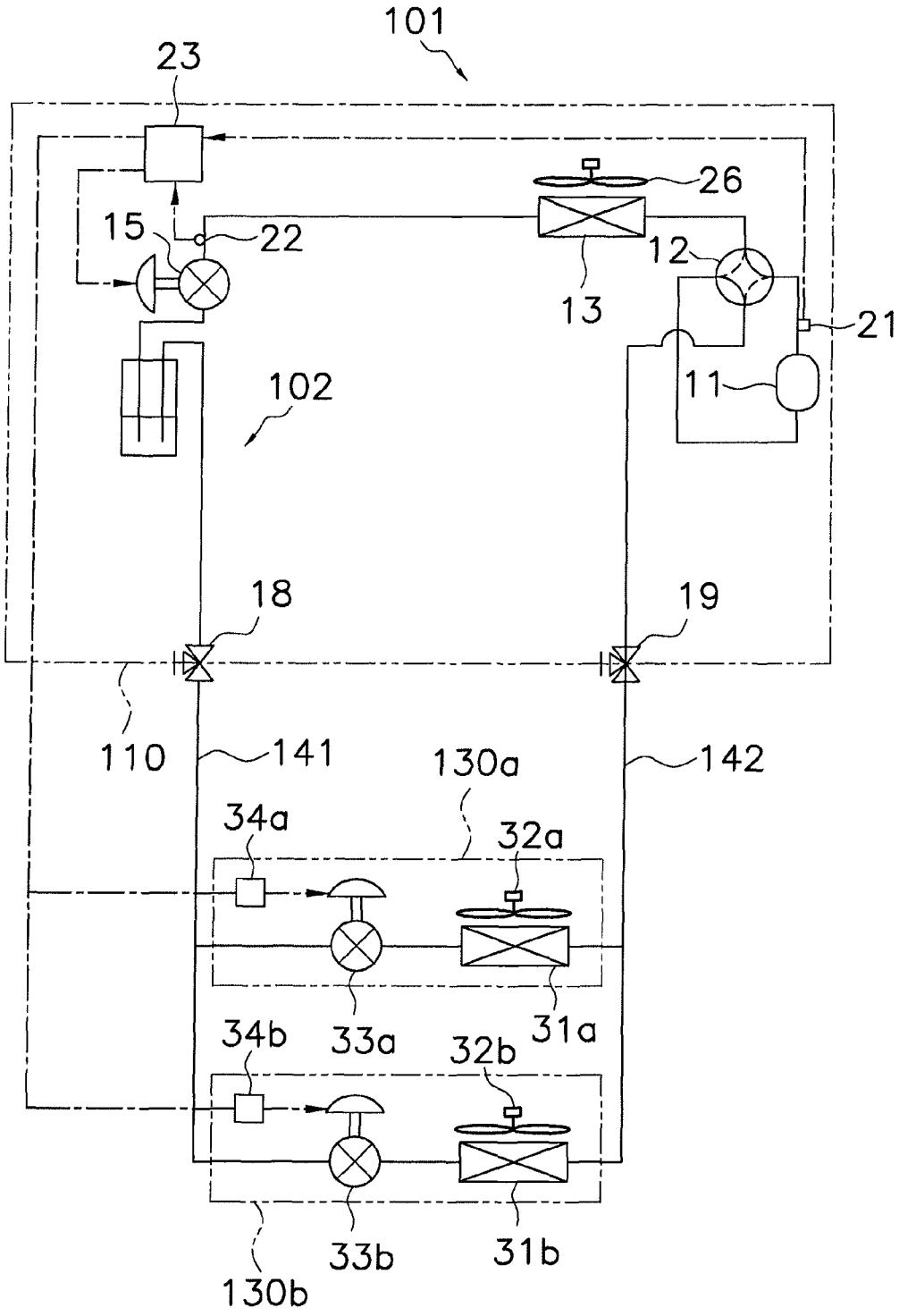
FIG. 4 is a diagram showing the refrigerant circuit of the air conditioning device according to Modification (A).

In the embodiment described above, the invention of the present application is applied to a separate-type air conditioning device 1 in which one indoor unit 30 is provided for one outdoor unit 10, but the invention of the present application may also be applied to a multi-type air conditioning device 101 in which a plurality of indoor units is provided for one outdoor unit, such as shown in FIG. 4. In FIG. 4, the same reference numerals are used to refer to components that are the same as those of the air conditioning device 1 according to the embodiment described above. In FIG. 4, the reference numeral 102 refers to a refrigerant circuit, 110 refers to an outdoor unit, 130*a* and 130*b* refer to indoor units, 31*a* and 31*b* refer to indoor heat exchangers, 32*a* and 32*b* refer to indoor fans, 33*a* and 33*b* refer to second electric expansion valves, 34*a* and 34*b* refer to indoor control devices, and 141 and 142 refer to connecting pipes. In this case, the control device 23 controls the second electric expansion valves 33*a*, 33*b* via the indoor control devices 34*a*, 34*b*. The second electric expansion valves 33*a*, 33*b* are housed in the indoor units 130*a*, 130*b* in the present modification, but the second electric expansion valves 33*a*, 33*b* may alternatively be housed in the outdoor unit 110.

(B)

Figure 5:
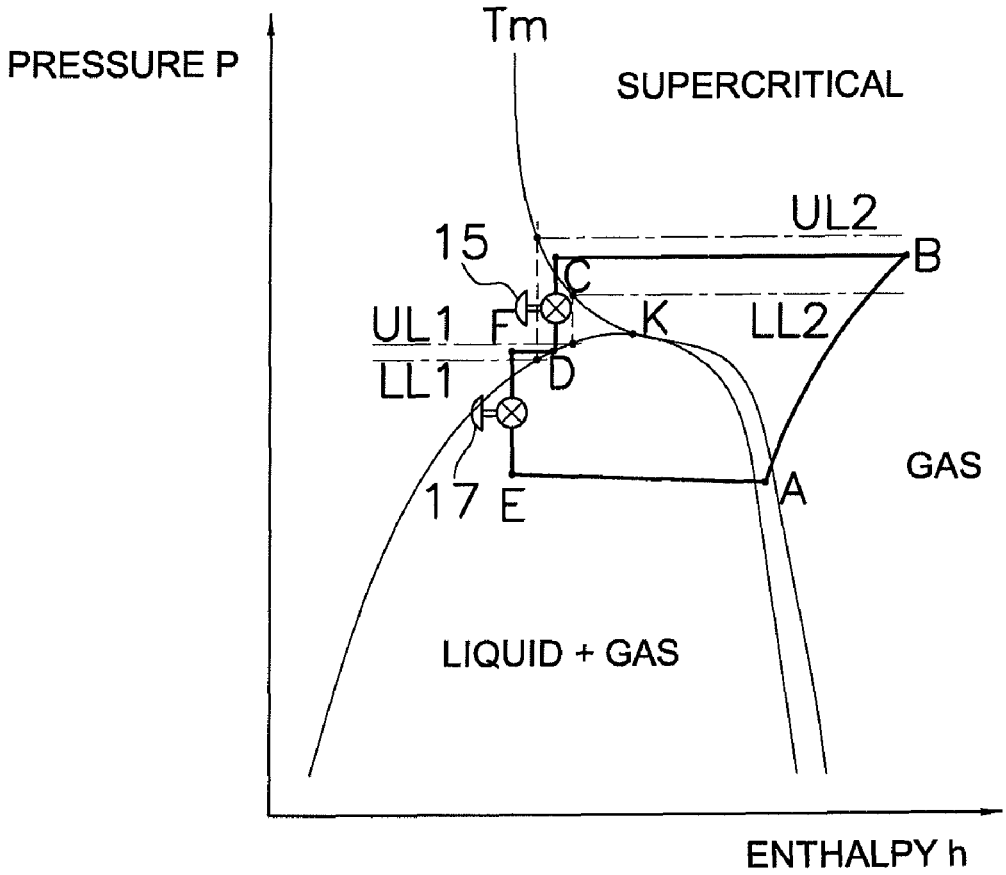
FIG. 5 is a diagram for describing the control of the level in the liquid receiver by the control device of the air conditioning device according to Modification (B).

In the air conditioning device 1 according to the embodiment described above, although not particularly mentioned in the above description, a supercooling heat exchanger (which may be an internal heat exchanger) may be provided between the liquid receiver 16 and the second electric expansion valve 17. In such cases, it will be necessary to set the upper limit UL1 and lower limit LL1 of the pressure of the intermediate-pressure refrigerant while also ensuring there is a difference in temperature between the high and low pressures of the supercooling heat exchanger. If such an arrangement is followed, it will be possible to avoid increasing the scale of the supercooling heat exchanger. The refrigeration cycle in such circumstances will be as shown in FIG. 5.

(C)

In the air conditioning device 1 according to the embodiment described above, the first electric expansion valve 15, the liquid receiver 16, the second electric expansion valve 17, and other components are disposed in the outdoor unit 10, but the positioning of these components is not particularly limited. For example, the second electric expansion valve 17 may be disposed in the indoor unit 30.

(D)

An electric expansion valve is used as the means for reducing the pressure of the refrigerant in the air conditioning device 1 according to the embodiment described above, but an expansion device or the like may instead be used.

(E)

Although not particularly mentioned in the air conditioning device 1 according to the embodiment described above, the liquid receiver 16 and the intake pipe of the compressor 11 may be connected to form a gas release circuit. In this case, an electric expansion valve, an electromagnetic valve, or the like is preferably provided to the gas release circuit.

(F)

Although not particularly mentioned in the air conditioning device 1 of the embodiment described above, it is possible to provide an intermediate-pressure sensor at any position between the refrigerant outflow side of the first electric expansion valve 15 and the refrigerant inflow side of the second electric expansion valve 17. In such cases, the control unit 23*c* controls the degree of openings of the first electric expansion valve 15 and the second electric expansion valve 17 so that the value shown by the high-pressure sensor 21 will fall between the upper limit UL2 and lower limit LL2 of the pressure of the high-pressure-side refrigerant as determined above, and so that the value shown by the intermediate-pressure sensor will fall between the upper limit UL1 and lower limit LL1 of the pressure of the intermediate-pressure refrigerant.

(G)

Although not specifically mentioned in the air conditioning device 1 of the previous embodiment, it is possible to provide a heat exchanger for cooling a refrigerant (which may be an internal heat exchanger) between the low-temperature side (or liquid side) of the outdoor heat exchanger 13 and the temperature sensor 22. In such cases, it will be possible to prevent the refrigerant flowing out of the first electric expansion valve 15 from assuming a state close to the supercritical point. According to the air conditioning device 1, therefore, the level in the liquid receiver can be stably controlled.

INDUSTRIAL APPLICABILITY

The refrigeration device of the present invention has the characteristic of enabling the refrigerant level in the liquid receiver to be stably controlled, and the present invention is particularly useful in a refrigeration device in which carbon dioxide or the like is used as the refrigerant.

What is claimed is:

1. A refrigeration device comprising:

a compression mechanism configured to compress a refrigerant;

a radiator connected to a refrigerant discharge side of said compression mechanism;

a first expansion mechanism connected to an exit side of said radiator;

a liquid receiver connected to a refrigerant outflow side of said first expansion mechanism;

a second expansion mechanism connected to an exit side of said liquid receiver;

an evaporator connected to a refrigerant outflow side of said second expansion mechanism and to a refrigerant intake side of said compression mechanism;

a temperature detector arranged to detect a refrigerant temperature between the exit side of said radiator and a refrigerant inflow side of said first expansion mechanism;

a pressure storing unit configured to store an upper limit and a lower limit of a first pressure of refrigerant flowing from the refrigerant outflow side of said first expansion mechanism to a refrigerant inflow side of said second expansion mechanism;

a pressure determining unit configured to determine an upper limit and a lower limit of a second pressure of refrigerant flowing from the refrigerant discharge side of said compression mechanism to the refrigerant inflow side of said first expansion mechanism, the pressure determining unit being configured to determine the upper limit and the lower limit of the second pressure based on the upper limit and lower limit of said first pressure and based on the refrigerant temperature detected by said temperature detector;

a pressure detector arranged to detect refrigerant pressure between the refrigerant discharge side of said compression mechanism and the refrigerant inflow side of said first expansion mechanism; and a control unit configured to control said first expansion mechanism and said second expansion mechanism so that said refrigerant pressure detected by said pressure detector will be equal to or less than the upper limit of said second pressure, said refrigerant pressure detected by said pressure detector will be equal to or greater than the lower limit of said second pressure, said first pressure will be equal to or less than the upper limit of said first pressure, and said first pressure will be equal to or greater than the lower limit of said first pressure.

2. The refrigeration device according to claim 1, further comprising a heat exchanger configured to cool refrigerant, the heat exchanger being disposed between the exit side of said radiator and the refrigerant inflow side of said first expansion mechanism; wherein said temperature detector is arranged to detect refrigerant temperature between an exit side of said heat exchanger and the refrigerant inflow side of said first expansion mechanism.

3. The refrigeration device according to claim 2, wherein the lower limit of said second pressure is a pressure at an intersection of a line of equal temperature which temperature is detected by said temperature detector with a line of isenthalpic which enthalpy is an enthalpy under the saturation state with the upper limit of said first pressure, and the upper limit of said second pressure is a pressure at an intersection of a line of equal temperature which temperature is detected by said temperature detector with a line of isenthalpic which enthalpy is an enthalpy under the saturation state with the lower limit of said first pressure.

4. The refrigeration device according to claim 3, wherein the lower limit of said second pressure is higher than the critical pressure of the refrigerant and the upper limit of said first pressure is lower than the critical pressure of the refrigerant.

5. The refrigeration device according to claim 4, wherein the refrigerant is carbon dioxide.

6. The refrigeration device according to claim 3, wherein the refrigerant is carbon dioxide.

7. The refrigeration device according to claim 2, wherein the lower limit of said second pressure is higher than the critical pressure of the refrigerant and the upper limit of said first pressure is lower than the critical pressure of the refrigerant.

8. The refrigeration device according to claim 7, wherein the refrigerant is carbon dioxide.

9. The refrigeration device according to claim 2, wherein the refrigerant is carbon dioxide.

10. The refrigeration device according to claim 1, wherein the lower limit of said second pressure is a pressure at an intersection of a line of equal temperature which temperature is detected by said temperature detector with a line of isenthalpic which enthalpy is an enthalpy under the saturation state with the upper limit of said first pressure, and the upper limit of said second pressure is a pressure at an intersection of a line of equal temperature which temperature is detected by said temperature detector with a line of isenthalpic which enthalpy is an enthalpy under the saturation state with the lower limit of said first pressure.

11. The refrigeration device according to claim 10, wherein the lower limit of said second pressure is higher than the critical pressure of the refrigerant and the upper limit of said first pressure is lower than the critical pressure of the refrigerant.

12. The refrigeration device according to claim 11, wherein the refrigerant is carbon dioxide.

13. The refrigeration device according to claim 10, wherein the refrigerant is carbon dioxide.

14. The refrigeration device according to claim 1, wherein the lower limit of said second pressure is higher than the critical pressure of the refrigerant and the upper limit of said first pressure is lower than the critical pressure of the refrigerant.

15. The refrigeration device according to claim 14, wherein the refrigerant is carbon dioxide.

16. The refrigeration device according to claim 1, wherein the refrigerant is carbon dioxide.

* * * * *